US009065167B2

(12) United States Patent
Pienkowski

(10) Patent No.: US 9,065,167 B2
(45) Date of Patent: Jun. 23, 2015

(54) ANTENNA MODIFICATION TO REDUCE HARMONIC ACTIVATION

(75) Inventor: Andrew Pienkowski, St. Neots (GB)

(73) Assignee: Broadcom Corporation, Irvine, CA (US)

( * ) Notice: Subject to any disclaimer, the term of this patent is extended or adjusted under 35 U.S.C. 154(b) by 0 days.

(21) Appl. No.: 13/248,876

(22) Filed: Sep. 29, 2011

(65) Prior Publication Data

US 2013/0081261 A1 Apr. 4, 2013

(51) Int. Cl.
*H01P 11/00* (2006.01)
*H01Q 7/00* (2006.01)

(52) U.S. Cl.
CPC ..... *H01Q 7/005* (2013.01); *Y10T 29/49016* (2015.01)

(58) Field of Classification Search
CPC ..... G06K 19/07749; H01P 11/00
USPC ..... 29/830–832, 600–601, 592.1; 343/725–728, 741, 866, 700 MS; 455/11.1, 67.11, 562.1
See application file for complete search history.

(56) References Cited

U.S. PATENT DOCUMENTS

| | | | | |
|---|---|---|---|---|
| 3,889,263 | A * | 6/1975 | Johannessen | 342/388 |
| 5,598,170 | A * | 1/1997 | Nakase | 343/704 |
| 5,815,076 | A * | 9/1998 | Herring | 340/572.5 |
| 6,452,557 | B1 * | 9/2002 | Twort | 343/713 |
| 6,624,795 | B2 * | 9/2003 | Boyle | 343/895 |
| 7,019,704 | B2 * | 3/2006 | Weiss | 343/770 |
| 7,936,309 | B2 * | 5/2011 | Lindenmeier et al. | 343/725 |
| 2002/0097109 | A1 * | 7/2002 | du Toit et al. | 333/26 |
| 2006/0132118 | A1 * | 6/2006 | Maekawa et al. | 324/96 |
| 2012/0315844 | A1 * | 12/2012 | Cox et al. | 455/41.1 |
| 2013/0081261 | A1 * | 4/2013 | Pienkowski | 29/600 |

* cited by examiner

*Primary Examiner* — Minh Trinh
(74) *Attorney, Agent, or Firm* — Sterne, Kessler, Goldstein & Fox P.L.L.C.

(57) ABSTRACT

An arrangement for modifying a printed circuit antenna of the type used in mobile communication devices includes introducing one or more discontinuities into a printed circuit pattern of the antenna so that it is not activated at undesired frequencies. Examples of discontinuities include localized narrowing the printed circuit strip, localized widening of the printed circuit strip and localized changing of the shape of the printed circuit strip.

13 Claims, 15 Drawing Sheets

ANTENNA MODIFICATION TO REDUCE HARMONIC ACTIVATION

BACKGROUND

1. Field of Invention

The invention relates generally to antennas used in mobile communication devices, such as cell phones. More particularly, the invention relates to antennas used for near field communication (NFC) and radio frequency identification (RFID).

2. Related Art

As mobile phones become more popular and they are providing more services on different frequency bands. Increasingly, mobile devices have not just a single antenna intended to handle voice communication, but rather a plurality of antennas for various communication services. For example, a mobile phone may include separate antennas for voice and data communication over several GSM cellular bands and CDMA bands. In addition to antennas for bands required for cellular communication, many mobile phones include antennas for Bluetooth® communication with peripheral devices, multiple bands of Wi-Fi and NFC. With added services, antenna complexity increases dramatically. It is becoming increasingly difficult to provide antenna arrangements suitable for supporting operation of all of these services.

In an ideal world, each service could have a dedicated antenna that is designed strictly for that service. It would have antenna characteristics that made it suitable for use in that service and would not radiate at frequencies outside of the intended band of operation. However, it is not practical to include multiple perfectly designed antennas in mobile phones. Some mobile phones have multiple antennas, each intended to support a particular communication service. Sometimes design compromises must be made in the interest of space and form factor that render one or more of the antennas less that "ideal" in the sense that they radiate beyond the intended band. Other mobile phones have single or multiple antennas at least some of which are designed to handle multiple communication services. These services operate on diverse frequencies. Antennas must be designed to radiate in different frequency ranges. This makes them susceptible to becoming activated (by induced currents) to radiate at frequencies not intended, such as, for example, a harmonic frequency of an intended radiation frequency of a neighboring antenna.

The various communication services have different nonlinear components associated with them which may cause unintended harmonics to appear which may in turn activate one or more neighboring antennas with the same device.

Alternatively, an antenna system within a mobile or other device may radiate sufficiently at a harmonic or intermodulation frequency that the whole device is close to failing electromagnetic compatibility specifications (EMC).

It is difficult to design an antenna for a small space, such as the space available in a mobile phone that will radiate only frequencies intended to be radiated. Many antenna designs have a wide range of "undesired" frequencies at which they may radiate.

Circuits driving these antennas are often not designed to generate only the exact frequencies desired to be radiated. It is well known that a pure "sine" wave at frequency f1 in the time domain generates only a single frequency f1 in the frequency domain. However, as shown in FIG. 1, a square wave at frequency f1 generates not only frequency f1, but also many harmonics of frequency f1. Driver circuits that are imperfect (it is not practical to build "perfect" circuits that will not generate some undesirable harmonics of desired frequency signals) generate harmonics that may be radiated by antennas even though it is desired that they not be radiated. This is wasteful of energy and can cause interference. It can even cause radiation to occur in violation of energy and spectrum requirements set by various laws and regulations intended to control the radiation spectrum assigned to various classes of wireless services.

What is needed is a simple and cost-effective way to reduce unwanted spurious emissions from antennas of the type commonly used in mobile communications devices, particularly those used for NFC and RFID communications in the 13.56 MHz. frequency band; to do so without substantially affecting radiation characteristics at desired frequencies.

BRIEF DESCRIPTION OF THE DRAWINGS/FIGURES

The accompanying drawings, which are incorporated herein and form part of the specification, illustrate the present invention and, together with the description, further serve to explain the principles of the invention and to enable a person skilled in the relevant art(s) to make and use the invention.

FIG. 1 (Prior Art) schematically depicts how a square wave or other non-sinusoidal signal is composed of potentially undesirable harmonic frequencies.

FIG. 2 (Prior Art) schematically depicts a NFC or RFID printed circuit antenna used in a mobile phone.

FIG. 3 schematically illustrates an antenna having many discontinuities incorporated therein in accordance with the invention.

FIG. 10 is a graphical representation indicating a frequency range of scans carried out, the results of which are shown in FIGS. 10-16.

FIG. 11 is a spatial representation of portions of the NFC antenna showing how the antenna is activated when driven simultaneously with all the frequencies monitored in the frequency scan of FIG. 10.

FIG. 12 is a spatial representation of a NFC antenna showing which portions are activated at a frequency of 108.00 MHz.

FIG. 13 is a spatial representation of a NFC antenna showing which portions are activated at a frequency of 111.00 MHz.

FIG. 14 is a spatial representation of a NFC antenna showing which portions are activated at a frequency of 114.00 MHz.

FIG. 15 is a spatial representation of a NFC antenna showing which portions are activated at a frequency of 120.00 MHz.

Figure 1:
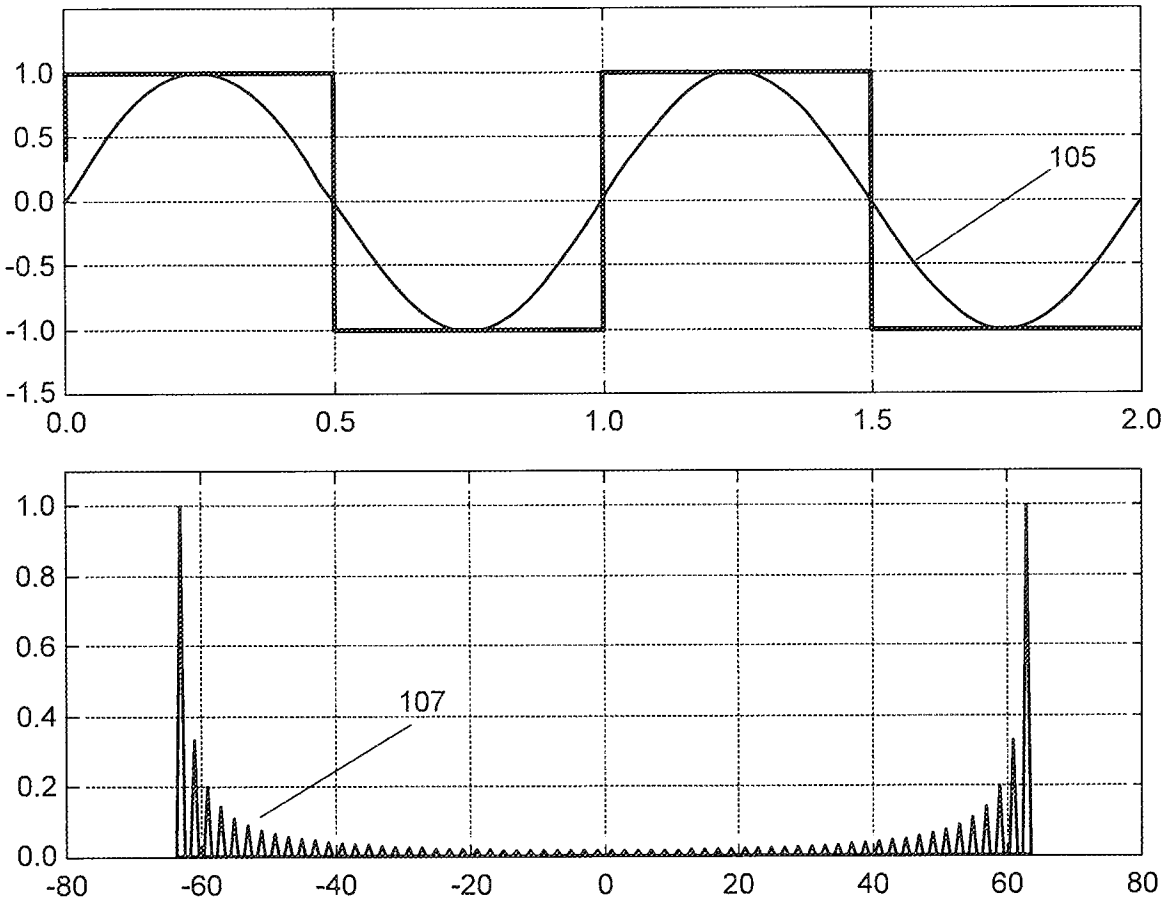
FIG. 1 (Conventional Art)

Features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION

The disclosed embodiment(s) merely exemplify the invention. The scope of the invention is not limited to the disclosed embodiment(s). The invention is defined by the claims appended hereto.

The embodiment(s) described, and references in the specification to "one embodiment", "an embodiment", "an example embodiment", etc., indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is understood that it is within the knowledge of one skilled in the art to affect such feature, structure, or characteristic in connection with other embodiments whether or not explicitly described.

Embodiments of the invention may be implemented in hardware, firmware, software, or any combination thereof.

As mentioned in the background section of this patent document, FIG. 1 (Prior Art) schematically depicts how a square wave 103 is rich in harmonic frequencies 107 from a non-linear driver circuit which is distinct from a pure sine wave such as sine wave 105. The use of a square wave is just to illustrate the point. The square wave is the extreme example. In practical mobile phone integrated circuit chips, waveforms are not as perfect as theoretically desired. Even though, as in the extreme example illustrated, a square wave may not be substituted for a sign wave, the desired waveform is often distorted in some way. This distorted wave, when driving any non-linear device, even an antenna, may cause undesirable harmonic signals to flow in the antenna structure. These undesirable harmonics may be radiated by an antenna that is activated and cause it to radiate at frequencies for which it was not designed. This can cause a cell phone to not pass its electromagnetic spectrum qualification test (EMC).

Figure 2:
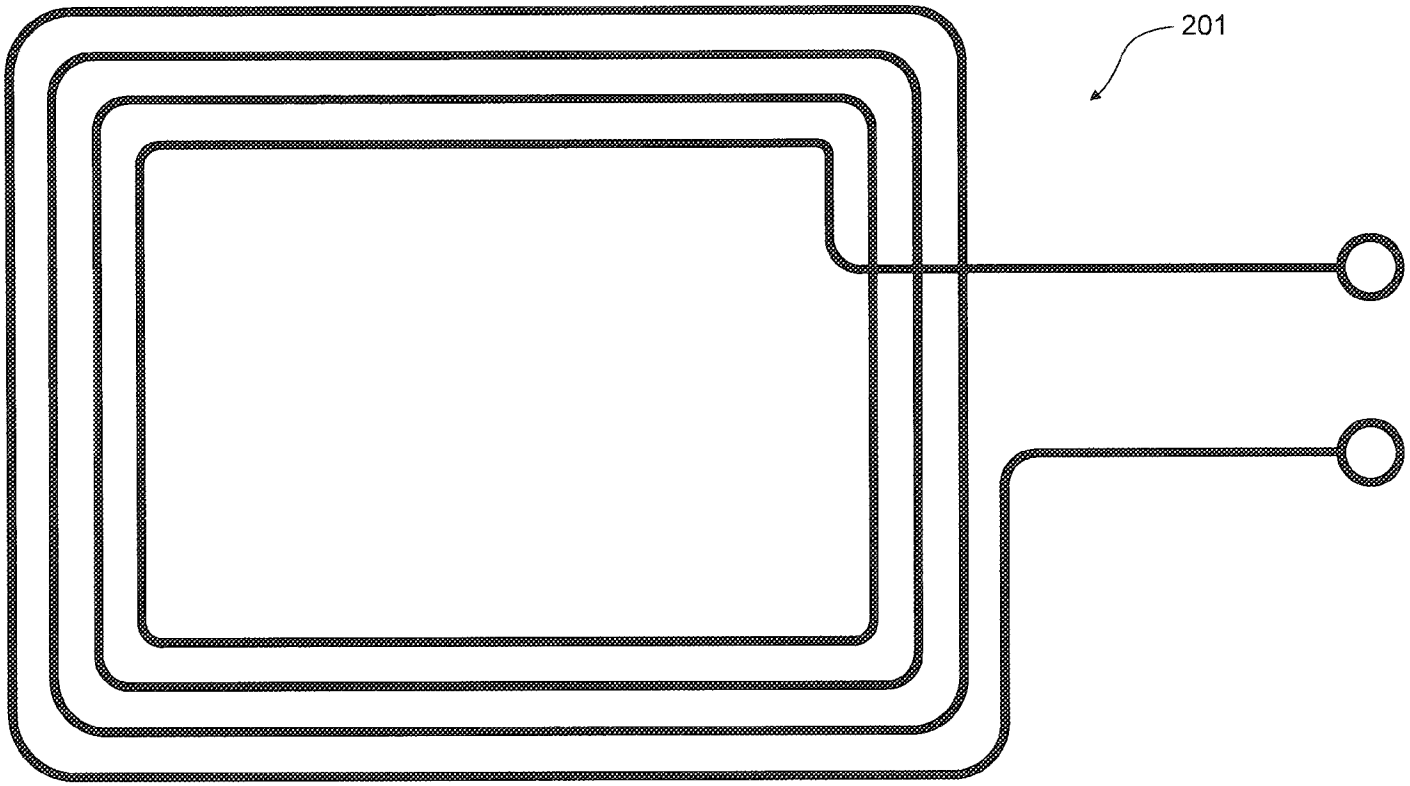
FIG. 2 (Conventional Art)

FIG. 2 (Prior Art) schematically depicts a printed circuit antenna 201 used in a mobile phone. Printed circuit antennas are available in many configurations and arrangements to operate on various frequency bands. With the multitude of communication bands on which a mobile phone operates, antennas cannot be optimally designed based on the form factor available. Also, multiple antennas may (not by design choice) couple to one another and induce currents in one another that may be a problem. The printed circuit loop pattern shown in FIG. 2 is merely illustrative. Other types of antenna patterns include simple dipoles, monopoles, circular, helix, etc. The principles of the present invention apply to all such patterns and form factors.

Figure 3:
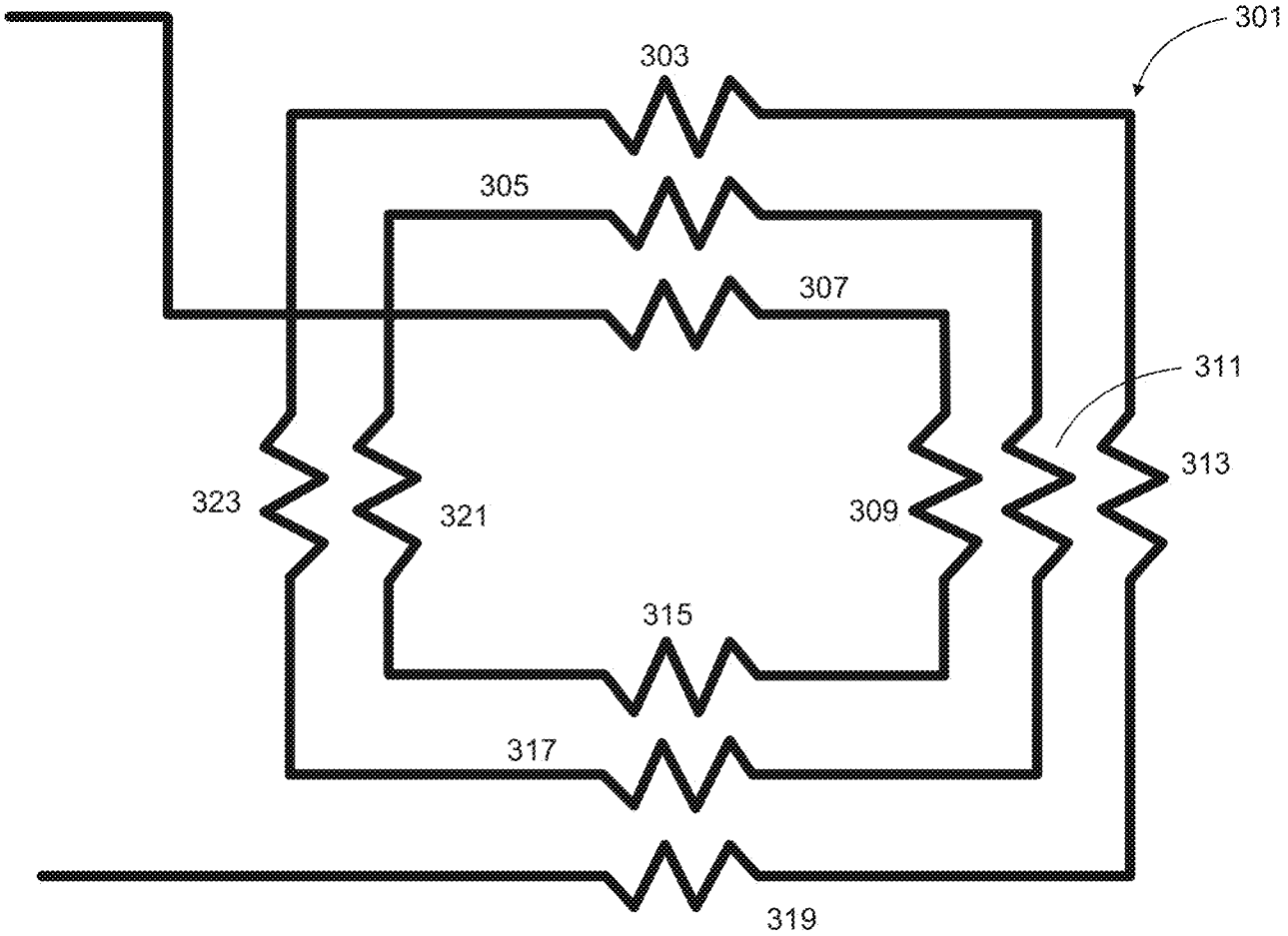

FIG. 3 schematically illustrates a principle of the invention. An antenna pattern 301 is schematically represented. There are illustrated eleven areas 303, 305, 307, 309, 311, 313, 315, 317, 319, 321, and 323 represented by jagged lines where discontinuities have been intentionally introduced in accordance with the principles of the invention. The purpose of these discontinuities is to prevent the antenna from being "activated" and radiating at a known undesired frequency at that portion of the antenna. As schematically illustrated, they are shown in a regular pattern. However, they need not be and usually are not. According to the invention, a radiation pattern of various frequencies (including both desired and undesired frequencies) is measured and discontinuities are introduced at positions in the antenna circuit pattern that are "activated" at undesired frequencies. The discontinuities are sized generally commensurate with the dimensions of the printed circuit pattern of the antenna into which they are formed. The bow tie discontinuity can be fabricated in accordance with a traditional design strategy based on the frequency desired to be blocked—a way of terminating quarter wave microstrip lines with flared open circuits to make a short circuit, or some impedance between an open and a short. The method of measuring and modifying is explained with reference to FIG. 4.

Figure 4:
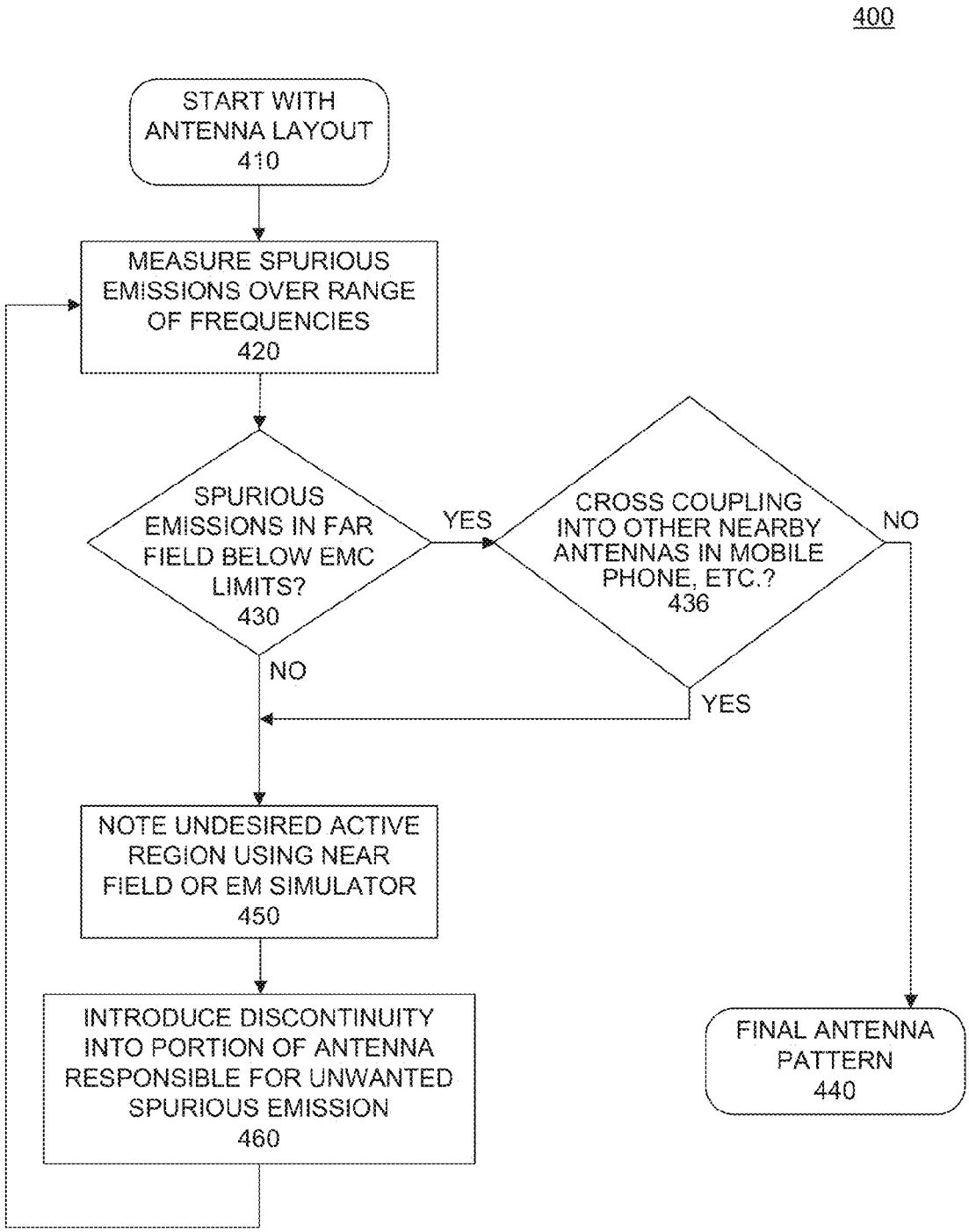
FIG. 4 is a flow chart of a method of modifying an antenna arrangement according to an embodiment of the invention.
Figure 5:
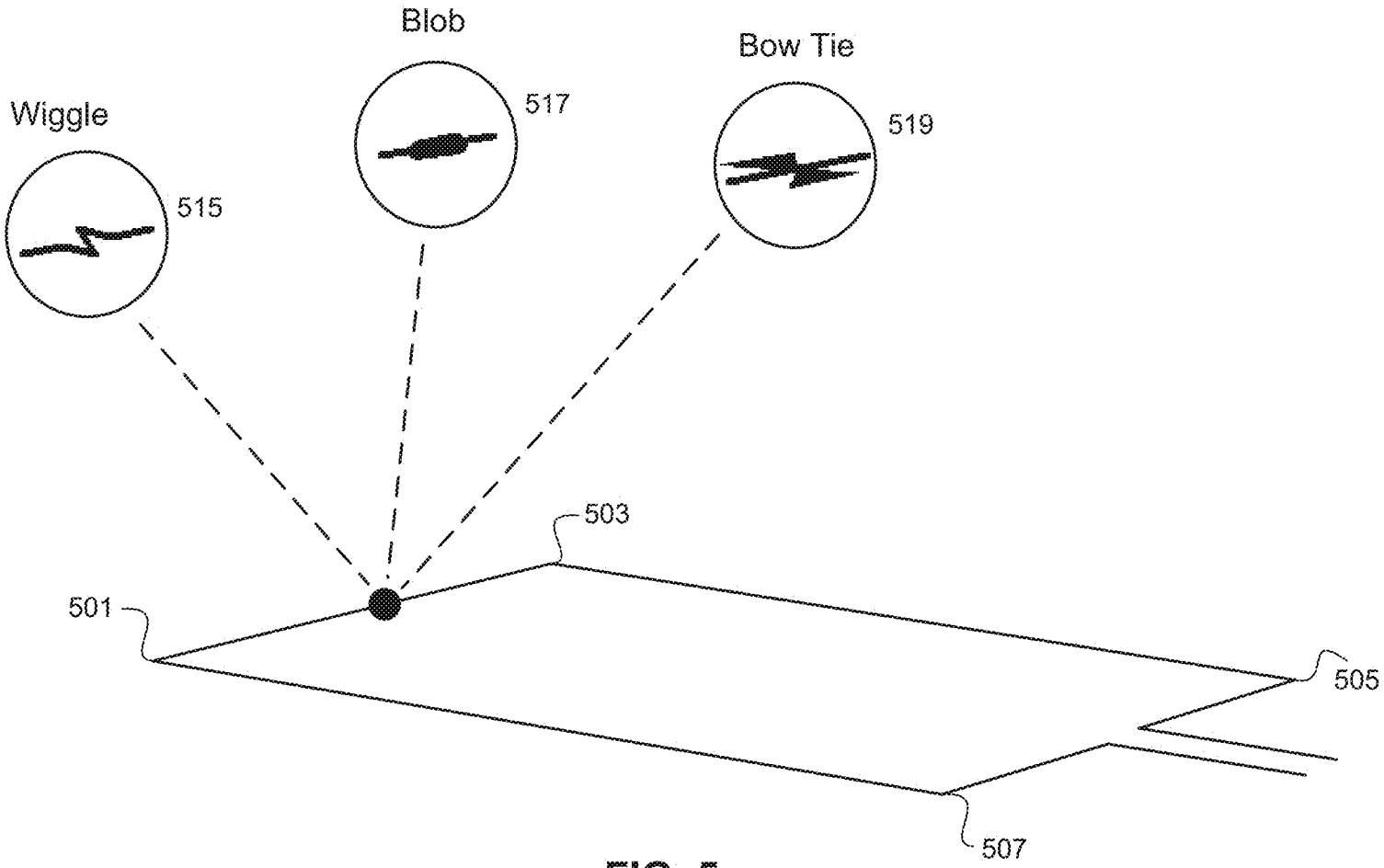
FIG. 5 is a schematic diagram illustrating embodiments of three types of discontinuities that can be introduced into an antenna element in accordance with the invention.

FIG. 4 is a flow chart of a method 400 of modifying an antenna arrangement according to an embodiment of the invention. At step 410 an antenna layout is identified for potential modification. At step 420, the antenna is driven with the imperfect, non-linear driver for which a range of frequencies, waveforms and radiation patterns are measured. Measurement tools are available for carrying out this step. One such tool is illustrated in FIG. 5 and will be further explained below. The radiation from the antenna is examined at step 430. If the pattern does not reveal any unintended spurious radiation that is problematic, the process ends at step 440. However, if any spurious radiation is identified, the portions of the antenna pattern that are radiating that spurious radiation are identified at step 450. At step 460 one or more discontinuities are introduced into the printed circuit pattern. Such discontinuity may take a form as shown for examples in FIG. 5. Other such discontinuities may be introduced as well. After any discontinuities have been introduced, measurements are again made at step 420. The process steps 420, 430, 450 and 460 are repeated until an acceptable reduction in unwanted frequencies is measured at step 430. Only then, does the process end. In effect, by carrying out the process of FIG. 4, one is tailoring performance of an antenna(s) by adding one or more discontinuities to react against specific problem frequencies. These problem frequencies cause electronic devices to fail EMC spurious emissions limits or cause it to interfere with other close proximity radio systems.

To properly apply the method described with respect to FIG. 4, it is necessary to analyze a particular mobile phone or other multifunction radio device together with its antennas to determine what harmonics of various communication services may be a problem. For example, consider the case of a mobile phone including an FM Radio and NFC capability. The $7^{th}$ harmonic of the NFC frequency falls within the FM Radio's intended reception band and may be "heard" by a user. Thus, before beginning the process of measuring and adding discontinuities, it is appropriate to perform an analysis to determine which frequencies of spurious radiation may be problematic for a particular mobile phone with its related communication services. An example of such analysis follows:

FIG. 5 is a schematic diagram illustrating embodiments of three types of discontinuities that can be introduced into an antenna element in accordance with the invention. Each "corner", such as corners 501, 503, 505, and 507 provide natural discontinuities which will tend to deactivate an antenna portion at certain spurious unwanted frequencies. In addition to the natural "corner" discontinuities, additional discontinuities are introduced at points such as point 509 at which a discontinuity is needed in order to prevent a portion of the antenna from being activated at an undesirable harmonic frequency. As examples, three types of discontinuities are shown in FIG. 5. One such discontinuity takes the form of a "wiggle" 515. A second such discontinuity takes the form of a "blob" 517. A third such discontinuity takes the form of a "bow tie" 519.

Figure 6:
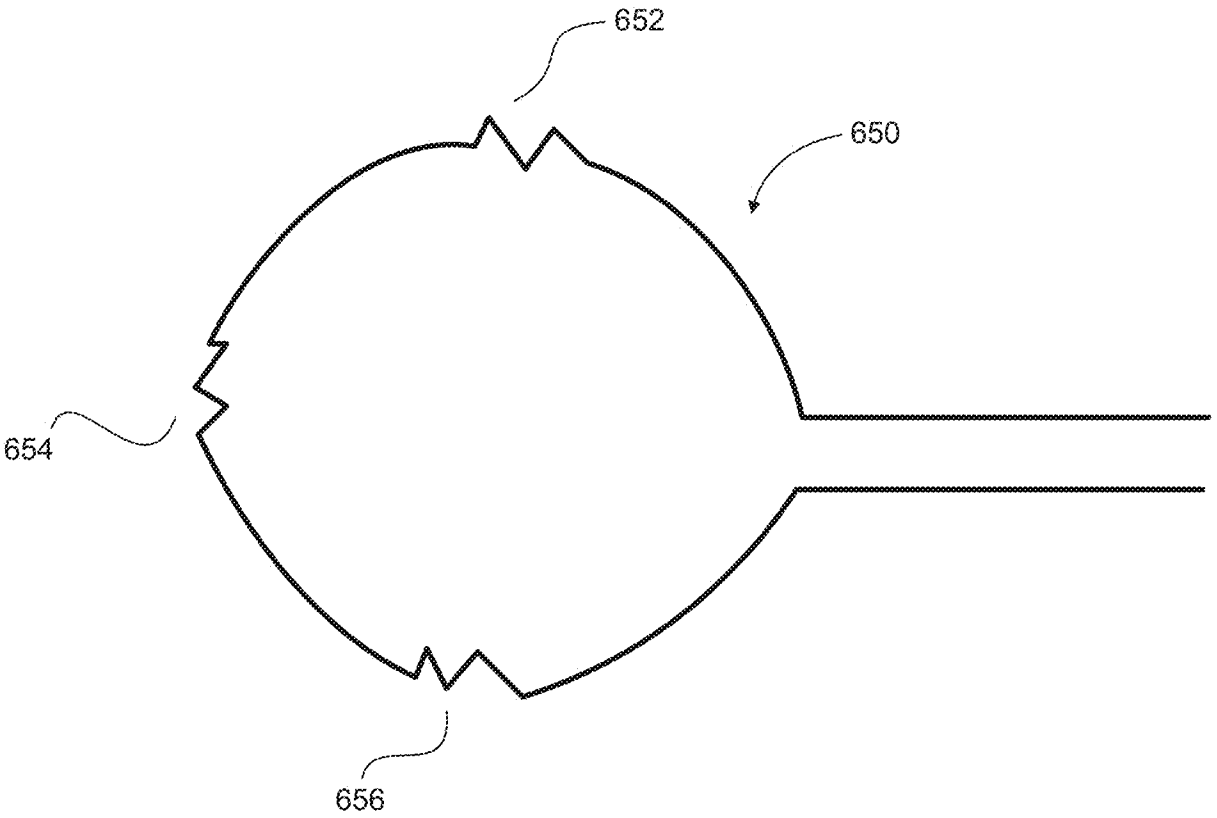
FIG. 6 is a schematic diagram of an exemplary circular-shaped antenna. The same discontinuities as shown in FIG. 5 can be used in the circular-shaped antenna shown in FIG. 6.

FIG. 6 is a schematic diagram illustrating an embodiment of the invention using a circular-shaped antenna pattern 650. Discontinuities 652, 654, and 656 are of similar construction to those shown in FIG. 5.

Figure 7:
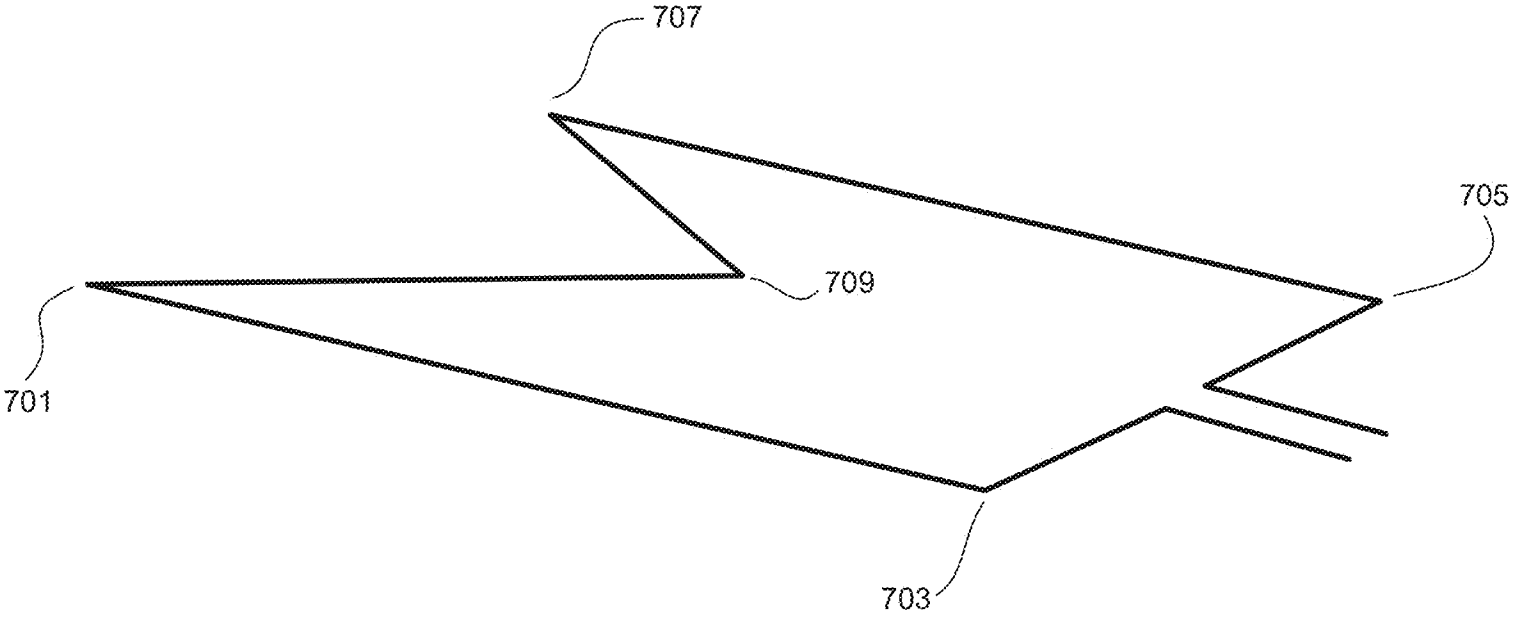
FIG. 7 is a schematic diagram illustrating an embodiment of an antenna element having an extra "corner" in accordance with the invention.

FIG. 7 is a schematic diagram illustrating an embodiment of an antenna element having an extra "corner" in accordance with the invention. The original antenna element was rectangular and had corners 701, 703, 705 and 707. In this embodiment, a further discontinuity was needed between corners 701 and 707. Rather than introducing a discontinuity such as the examples shown in FIG. 5, the portion of the antenna between corners 701 and 707 was re-shaped to form an additional corner 709. One of the factors influencing whether to use a discontinuity such as shown in the examples of FIG. 5 or re-shape a portion of the antenna is space availability. Although FIG. 5 schematically illustrates several examples of modifications that can be made to the standard printed circuit antenna pattern in order to introduce discontinuities according to embodiments of the invention, other modifications are possible.

Printed antenna patterns can be altered in a number of ways and manners to introduce desired discontinuities in order to deal with the problem of spurious emissions. For example a printed antenna pattern might be altered in either two or three dimensions. One can utilize one form of discontinuity and multiple points of an antenna or utilize various of these forms in the same antenna. The different shapes of discontinuity may have various effects at various frequencies. The common thread is to utilize a discontinuity to block a particular antenna activation frequency at a particular point in the antenna. Each combination of antenna and frequencies will require a different arrangement of discontinuities to deal with the particular spurious emissions emanating from the antenna structure.

For example, if a mobile phone supports services in frequency bands A, B and C and a harmonic of a signal from band A falls in band C, it may be desirable to introduce a discontinuity in the band C antenna to block the harmonic that may cause a problem.

As another example, the printed antenna pattern can be made to have an additional "corner" by forcing it to have an angular bend. For antennas that are originally designed to have corners, such as shown in FIGS. 2, 5, 7 and 8, the corners act as natural discontinuities. Additional corners can be added where needed. As another example, a printed antenna pattern can be made to narrow or bulge at a place where a discontinuity is desired.

Figure 8:
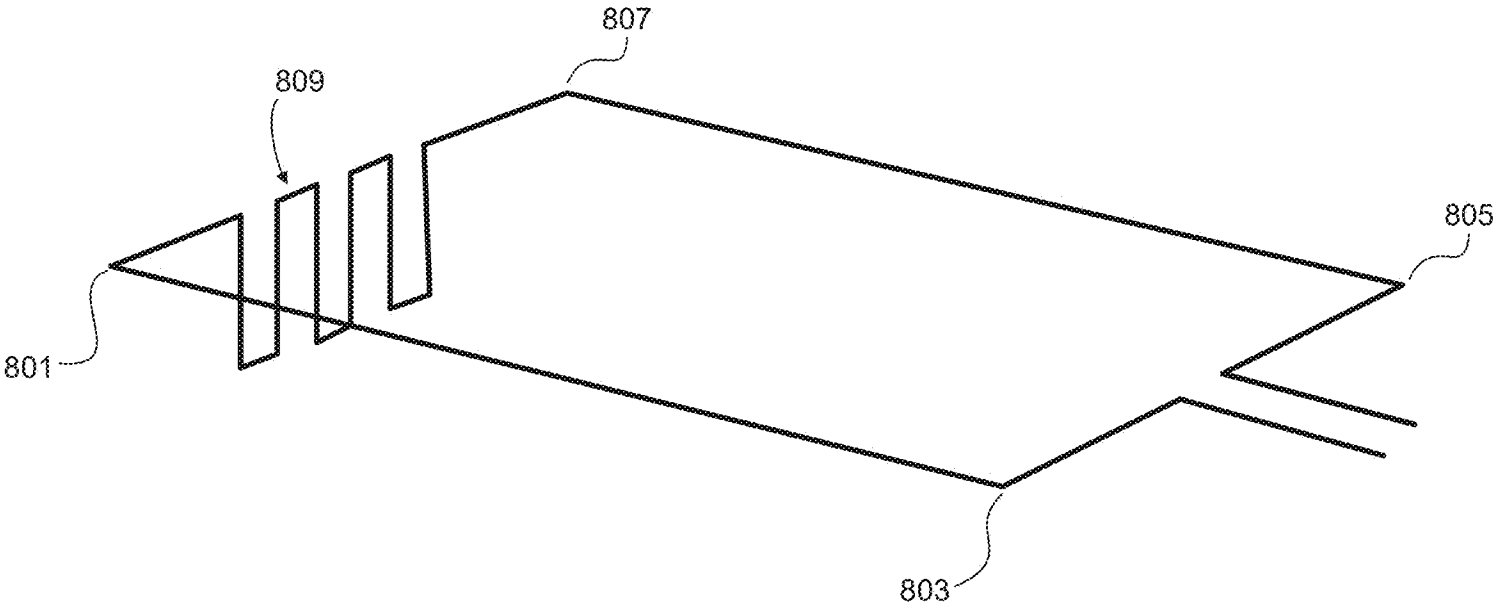
FIG. 8 is a schematic diagram illustrating an embodiments of the invention in which discontinuities are introduced in a third dimension perpendicular to the "flat" dimensions of an antenna using an extension or additional layer of a fabricated circuit board.

FIG. 8 is a schematic diagram illustrating an embodiments of the invention in which discontinuities are introduced in a third dimension perpendicular to the "flat" dimensions of an antenna. This approach is useful when there is room available in the "depth" dimension to introduce a discontinuity. In this embodiment, a three-dimensional discontinuity is introduced into an antenna element having corners 801, 803, 805, 807. The portion of the antenna element between corners 801 and 807 is modified to include several (as shown) runs of conductor in a dimension perpendicular to the plane of the original antenna element to form discontinuities 809.

Figure 9:
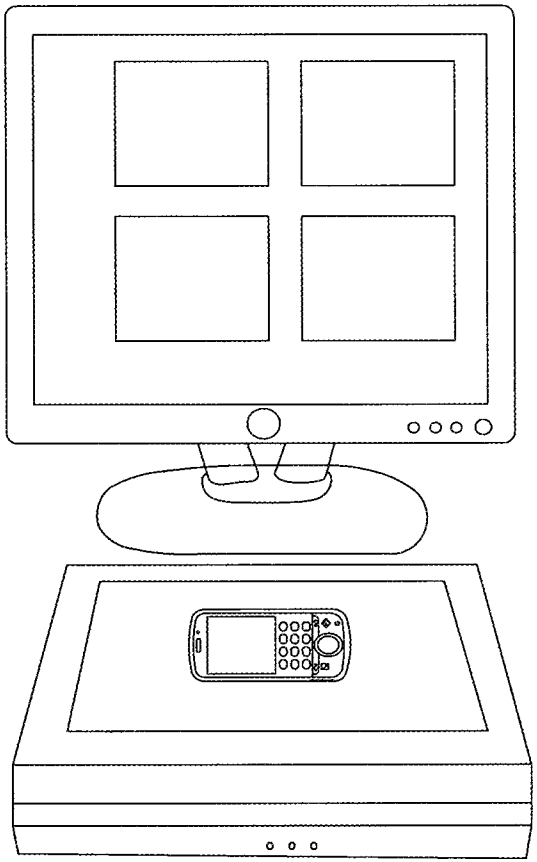
FIG. 9 illustrates typical near field measurement equipment for sensing radiation from an antenna of a mobile phone.

FIG. 9 illustrates equipment for measuring radiation from an antenna of a mobile phone. As an example, the figure illustrates equipment produced by EMscan, headquartered in Calgary, Canada. However, other radiation measurement and plotting tools can be used as well.

FIGS. 10-15 are graphical representations representing scanning carried out with equipment such as shown in FIG. 9 as an example using 80 MHz harmonics in a near field (NFC) antenna of a wireless device.

Figure 10:
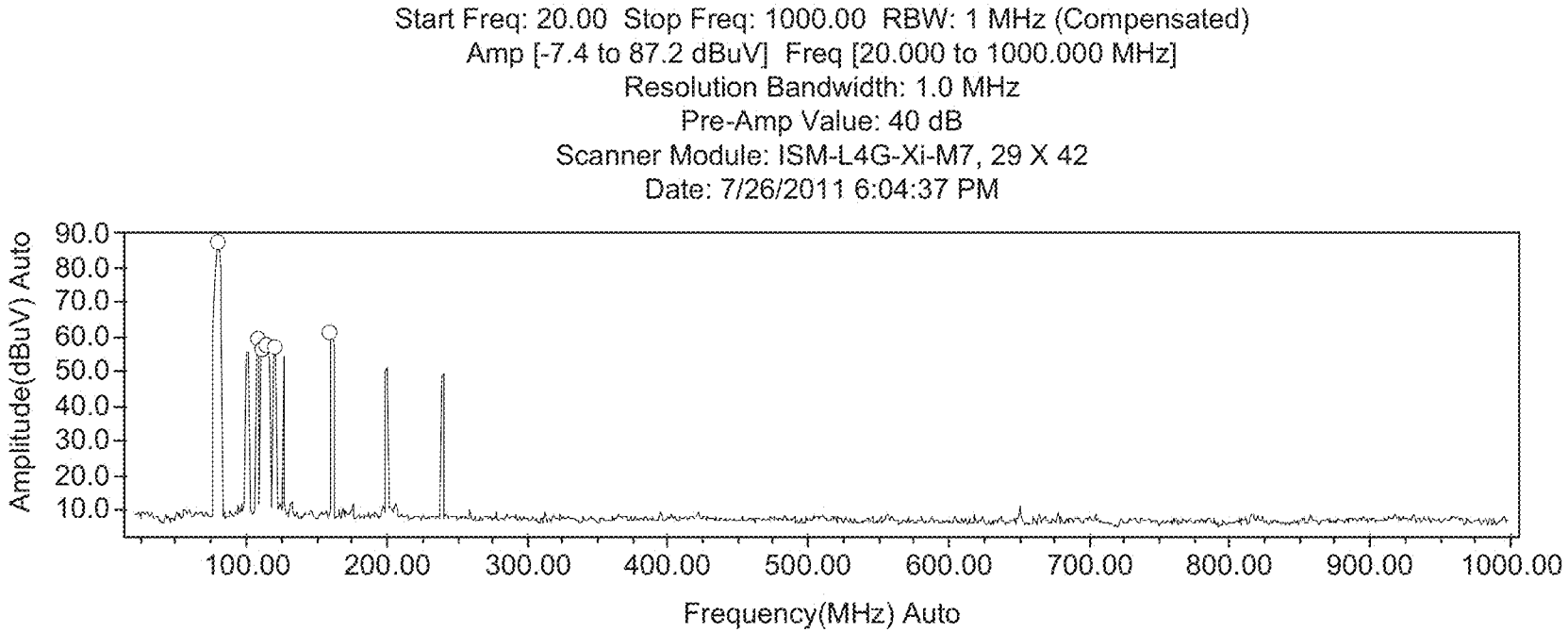
FIGS. 10-15 are graphical representations representing scanning carried out with equipment such as shown in FIG. 8 as an example using 80 MHz harmonics in a near field (NFC) antenna of a wireless device.

FIG. 10 is a graphical representation indicating spectral frequencies present with a given antenna structure when it has been driven at a fundamental frequency of 80 MHz.

Figure 11:
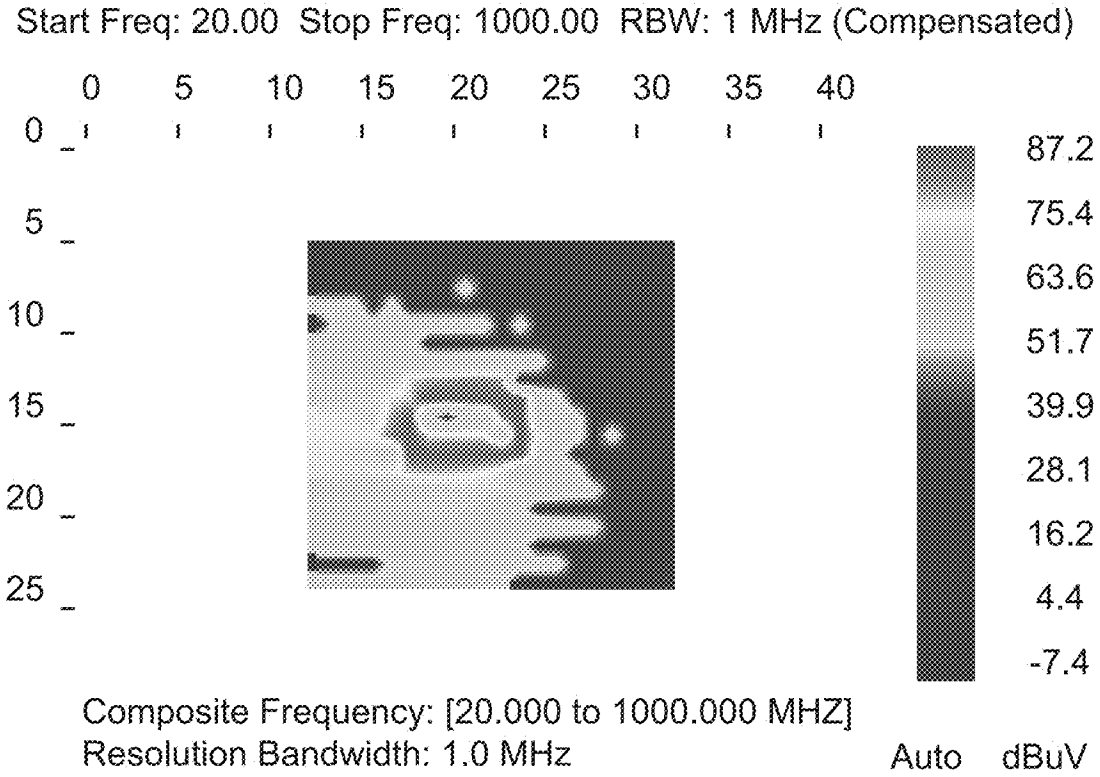

FIG. 11 is a spatial representation of portions of the NFC antenna showing which portions of the antenna are activated at particular scan frequencies in a range starting at 20 MHz and stopping at 1000 MHz. For each of the spectral lines present in the frequency plot of FIG. 9, a spatial plot is given in FIGS. 10-16 showing the particular sub-elements of the antenna which radiate as a result of being particularly transmissive at specific spurious frequencies.

Figure 12:
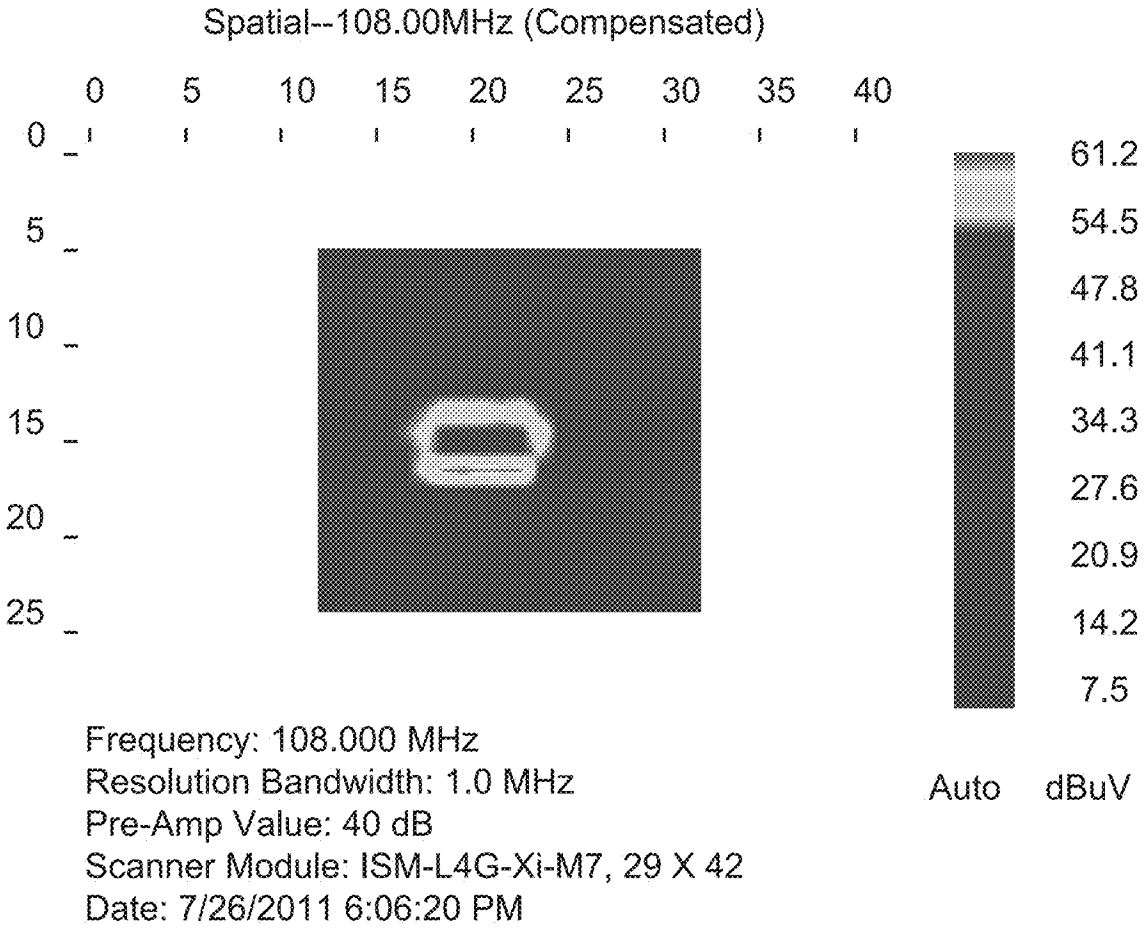

FIG. 12 is a spatial representation of portions of a NFC antenna showing which portions are activated at a frequency of 108 MHz. These portions of the antenna can now be targeted with additional discontinuities at no extra cost to reduce the radiation capability at 108 MHz.

Figure 13:
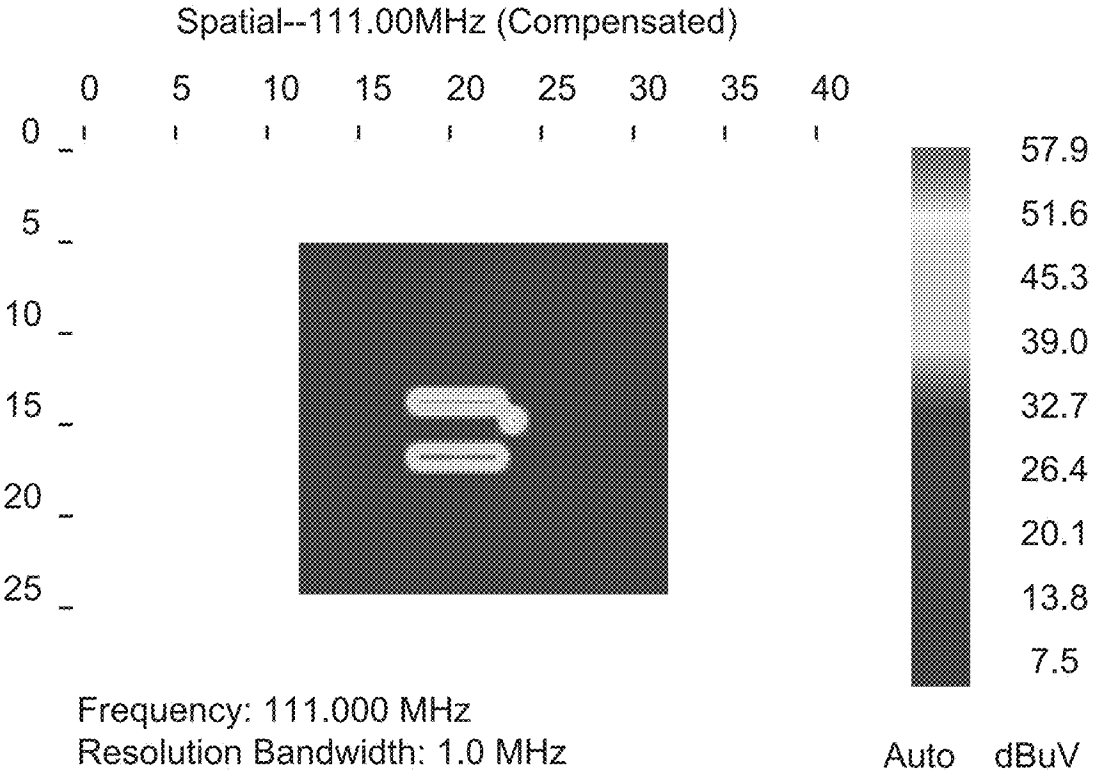

FIG. 13 is a spatial representation of portions of a NFC antenna showing which portions are activated at a frequency of 111 MHz. These portions of the antenna can now be targeted with additional discontinuities at no extra cost to reduce the radiation capability at 111 MHz.

Figure 14:
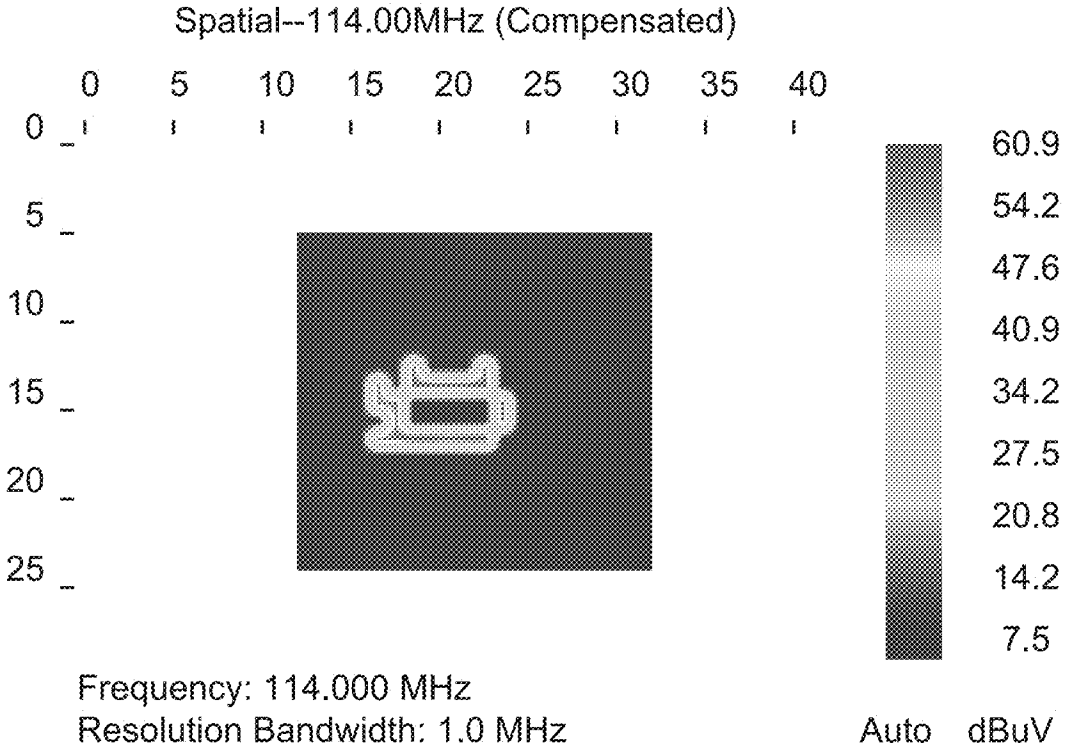

FIG. 14 is a spatial representation of portions of a NFC antenna showing which portions are activated at a frequency of 114 MHz. These portions of the antenna can now be targeted with additional discontinuities at no extra cost to reduce the radiation capability at 114 MHz.

Figure 15:
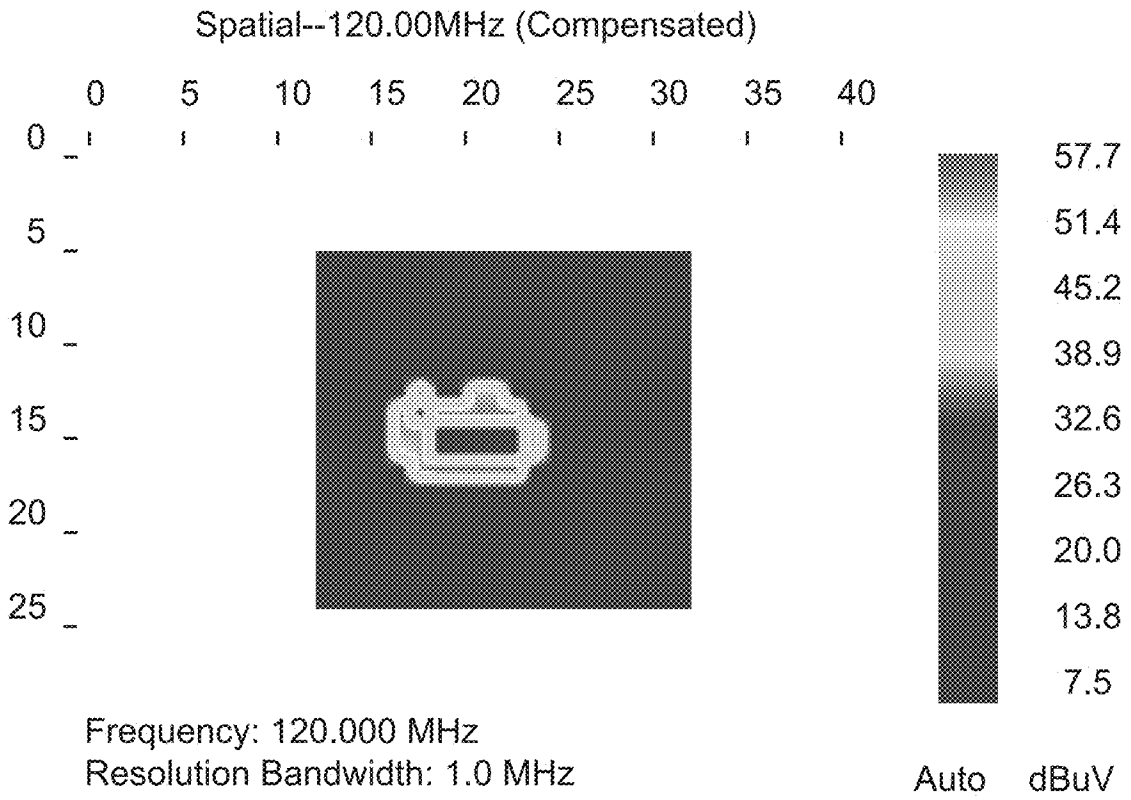

FIG. 15 is a spatial representation of portions of a NFC antenna showing which portions are activated at a frequency of 120 MHz. These portions of the antenna can now be targeted with additional discontinuities at no extra cost to reduce the radiation capability at 120 MHz.

Conclusion

The term "discontinuity", where the context allows, refers to any one or combination of changes made to a portion of a printed circuit pattern. This includes modifying the shape of the pattern in some way. It also includes interrupting the circuit pattern and inserting one or more electronic components, such as resistors, capacitors, inductors, etc. which do not interfere with the desired antenna performance but reduce particular problem spurious emissions.

The modifications described herein to address spurious radiation are essentially "no cost" in the sense that this approach does not necessarily require the addition of circuit components or modifications that require significant additional material in order to be effective.

While specific embodiments of the invention have been described above, it will be appreciated that the invention may be practiced otherwise than as described for VHF, UHF and microwave systems.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A method for modifying an antenna arrangement, the method comprising:

providing the antenna arrangement including an antenna having a plurality of antenna portions;

driving the antenna using a waveform that includes at least one desired frequency at which it is desired for the antenna to radiate and at least one undesired frequency at which it is undesired for the antenna to radiate;

measuring undesired radiation from at least one antenna portion, from among the plurality of antenna portions, at the at least one undesired frequency; and modifying the antenna arrangement by introducing a discontinuity at the at least one antenna portion to reduce the undesired radiation from the at least one antenna portion at the at least one undesired frequency.

2. The method according to claim 1, wherein the discontinuity is configured to be in a "wiggle" shape.

3. The method according to claim 1, wherein the discontinuity is configured to be in a "blob" shape.

4. The method according to claim 1, wherein the discontinuity is configured to be in a "bow tie" shape.

5. The method according to claim 1, wherein the discontinuity is configured to be in a dimension perpendicular to a plane of the antenna.

6. The method according to claim 1, further comprising:

measuring, after introducing the discontinuity, undesired radiation from the at least one antenna portion; and modifying the antenna arrangement by introducing an additional discontinuity at the at least one antenna portion to further reduce the undesired radiation from the at least one antenna portion at the at least one undesired frequency.

7. The method according to claim 1, wherein the at least one undesired frequency includes a harmonic of the at least one desired frequency.

8. The method according to claim 1, wherein the introducing the discontinuity includes re-shaping an existing shape of the at least one antenna portion.

9. The method according to claim 1, wherein the first undesired frequency includes a first undesired frequency and a second undesired frequency, and introducing the discontinuity includes introducing a first discontinuity of a first form to reduce undesired radiation at the first undesired frequency, and introducing a second discontinuity of a second form to reduce undesired radiation at the second undesired frequency.

10. The method according to claim 1, further comprising:

designing the antenna to radiate at a first desired frequency band and at a second desired frequency band.

11. The method according to claim 10, wherein introducing, the discontinuity includes introducing the discontinuity with respect to the first desired frequency band when the at least one antenna portion is capable of radiating an undesired harmonic of a signal from the second desired frequency hand, the undesired harmonic being within the first desired frequency band.

12. The method according to claim 1, wherein the introducing the discontinuity includes introducing an angular bend in place of an existing sharp corner at the at least one antenna portion.

13. The method according to claim 1, wherein introducing the discontinuity includes narrowing or broadening a cross-section of the at least one antenna portion.

* * * * *

UNITED STATES PATENT AND TRADEMARK OFFICE

CERTIFICATE OF CORRECTION

PATENT NO. : 9,065,167 B2
APPLICATION NO. : 13/248876
DATED : June 23, 2015
INVENTOR(S) : Andrew Pienkowski It is certified that error appears in the above-identified patent and that said Letters Patent is hereby corrected as shown below:

In the claims,

In column 8, lines 32-33, please replace “introducing, the discontinuity” with --introducing the discontinuity--.
In column 8, line 36, please replace “hand” with --band--.

Signed and Sealed this
Ninth Day of February, 2016

Michelle K. Lee

Michelle K. Lee
*Director of the United States Patent and Trademark Office*